US006092866A

United States Patent [19]

Wu

[11] Patent Number: 6,092,866

[45] Date of Patent: Jul. 25, 2000

[54] FOLDING CHAIR WITH SAFETY GUARD

[76] Inventor: Henry Wu, 23441 Golden Springs Dr. #370, Diamond Bar, Calif. 91765

[21] Appl. No.: 09/195,357

[22] Filed: Nov. 19, 1998

[51] Int. Cl.[7] ..... A47C 4/00

[52] U.S. Cl. ..... 297/56; 297/16.1

[58] Field of Search ..... 297/16.1, 55, 56, 297/452.18, 452.2

[56] References Cited

U.S. PATENT DOCUMENTS

| | | |
|---|---|---|
| 202,856 | 4/1878 | Morse et al. . |
| 937,567 | 10/1909 | Canouts . |
| 941,135 | 11/1909 | De Moulin . |
| 1,815,643 | 7/1931 | Allerding . |
| 1,838,213 | 12/1931 | Buffington . |
| 2,587,543 | 2/1952 | Smith . |
| 2,694,442 | 11/1954 | Nordmark . |
| 2,920,687 | 1/1960 | Hurley . |
| 2,973,803 | 3/1961 | Mickelson . |
| 3,025,101 | 3/1962 | McKinnie . |
| 3,695,687 | 10/1972 | Uyeda . |
| 5,738,408 | 4/1998 | Wu . |

*Primary Examiner*—Milton Nelson, Jr.
*Attorney, Agent, or Firm*—Knobbe, Martens, Olson & Bear, LLP

[57] ABSTRACT

A folding chair containing a pair of safety guards that are adapted to provide additional structural support to the chair. Each safety guard is comprised of a first member and a second member that are pivotally attached to each other at a central pivot point. Each safety guard is configured with an orthogonally extending lip on the first member and a corresponding indentation on the second member that, when combined, limit the possible orientations between the two members to range from an overlapping state to a linearly extended state. Both ends of each safety guard are pivotally attached to the chair in a manner that results in the safety guards being linearly extended when the chair is converted to a fully opened position and nearly overlapping when the chair is converted to a folded position.

13 Claims, 3 Drawing Sheets

FOLDING CHAIR WITH SAFETY GUARD

BACKGROUND OF THE INVENTION

1. Field of the Invention

The present invention relates to folding chairs and in particular relates to a folding chair that contains a safety guard to improve the structural integrity of the chair.

2. Description of the Related Art

People often use low cost folding chairs as a means for sitting in an upright position. In comparison to other seating devices, low cost folding chairs offer the advantages of being compact and lightweight. Therefore, folding chairs can be easily stored, easily transported, and supplied in great numbers at a reasonable cost.

A typical low cost folding chair consists of a seat rest, a back rest, and a plurality of foldable support structures that, when in an open position, enable the seat rest to support the weight of a person. Furthermore, the back rest helps to prevent the person from falling backwards while the person is seated in the seat rest.

The problem with many low cost folding chairs is that they sometimes lack sufficient structural integrity to support extremely heavy individuals. When a heavy individual sits in a folding chair, large internal forces are sometimes generated throughout the folding chair. It is possible for these forces to exceed the capabilities of the folding chair and result in a mechanical failure that can result in a collapse of the chair and possible injury to the person sitting in the chair.

Another problem with folding chairs is that they can sometimes inadvertently fold up while an individual is sitting in the chair. For example, if a person sitting in a folding chair attempts to pull himself forward toward a table, it is possible for the legs of the folding chair to experience forces that could cause the legs to fold together. Moreover, it is possible for the legs to approach each other to the extent that the stability of the chair could be compromised. In either circumstance, the person sitting in the chair may become unbalanced and possibly fall or, at a minimum, have to inconveniently readjust the chair.

The potential loss of mechanical stability in a folding chair poses a serious risk of injury to the user. Without a supporting structure, gravitational forces acting on an object placed at the height of 18 inches, the height of a typical seat rest, would cause the object to collide with the ground with a speed of 10 feet per second. If the ground were a solid structure such as concrete or brick, then a falling user would most likely experience extreme collision forces that could easily cause injury to the person. This problem is compounded by the likelihood that the person's rear end will often contact the floor first risking injury to the person's tailbone or possibly their back.

From the foregoing, it will be appreciated that there is a need for a folding chair that is capable of supporting the weight of extremely heavy individuals. To this end, there is a need for a chair that is more structurally sound such that a failure of one component or piece of the chair will not necessarily result in the user falling to the ground. Furthermore, this folding chair should be lightweight, easy to use, and inexpensive to produce. Furthermore, the folding chair should inhibit the user from inadvertently causing the folding chair to fold up while the user is sitting in the chair.

SUMMARY OF THE INVENTION

The aforementioned needs are satisfied by the folding chair of the present invention having a folded and an unfolded configuration which is comprised of a first chair support member defining a first left section and a second right section and a second chair support member defining a second left section and a second right section. Additionally, the first and second chair support members are pivotally attached to each other so that when the chair is in a folded configuration, the first and second right sections and the first and second left sections of the first and second chair support member are substantially co-planar. Furthermore, the first and second left sections and the first and second right sections form acute angles with each other when the chair is in the unfolded configuration.

The folding chair of the present invention is further comprised of a seat that is attached to the first and second chair support members so as to be positioned substantially co-planar with the first and second chair support members when the chair is in the folded configuration. Furthermore, the seat is attached to the first and second chair support members so that the seat is positioned so as to be substantially parallel to the surface upon which the first and second chair support members are positioned when the chair is in the unfolded configuration.

The folding chair of the present invention is further comprised of at least one safety brace member which includes a first and a second section that are pivotally attached to each other at a central pivot. Furthermore, the first section of the at least one brace member is pivotally attached in a fixed manner to the first chair support member at a first pivot and the second section of the brace member is pivotally attached in a fixed manner to the second chair support member at a second pivot. When the chair is in the unfolded position, the first and second sections of the at least one brace member are positioned so as to retain the first and second chair support members in a first relation with each other so as to reduce the tendency of a user falling to the surface upon which the first and second chair support members are positioned if the seat becomes dis-attached to the first or the second chair support. Additionally, the first and second section of the at least one brace member are pivotally attached to each other so that when the chair is in the folded position, the first and second sections of the at least one brace member are essentially coplanar with the first and second chair members.

In another aspect of the invention, the at least one safety brace member contains an orthogonally extending lip from the first member of the at least one brace member adjacent a first upper edge of the at least one brace member. This lip is adapted to engage with an indentation located along a second upper edge on the second member of the at least one safety brace member when the chair is placed in the unfolded configuration in a manner that causes the central pivot to remain collinear with the first and second pivots of the at least one brace member. As a consequence, the at least one brace member is biased into the linear configuration when the chair is converted to the unfolded configuration so as to inhibit a user who is sitting in the chair from inadvertently causing the chair to change to a folded configuration.

From the foregoing, it should be apparent that folding chair of the present invention contains supplementary structural elements that are sufficient to allow the chair to support the weight of extremely heavy individuals. Furthermore, the chair is capable of supporting extremely heavy individuals in the event that the seat becomes dis-attached from the chair. Moreover, the chair of the present invention is designed to prevent the possible occurrence of inadvertent folding of the chair when the user, who is seated in the chair in an unfolded configuration, pulls themselves toward a table. These and other objects and advantages of the present invention will become more apparent from the following description taken in conjunction with the accompanying drawings.

DETAILED DESCRIPTION OF THE PREFERRED EMBODIMENT

Figure 1:
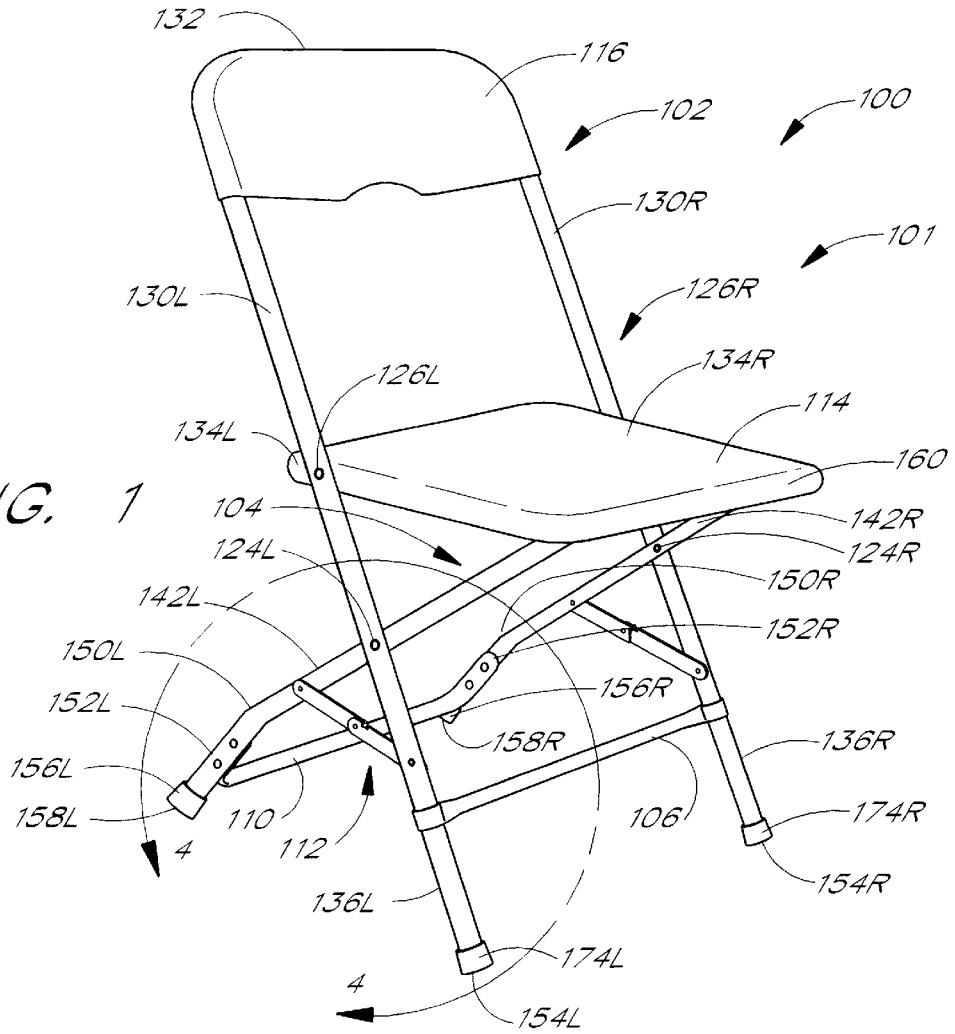
FIG. 1 is a perspective view of a folding chair of the present invention with the chair shown in an open position.
Figure 2:
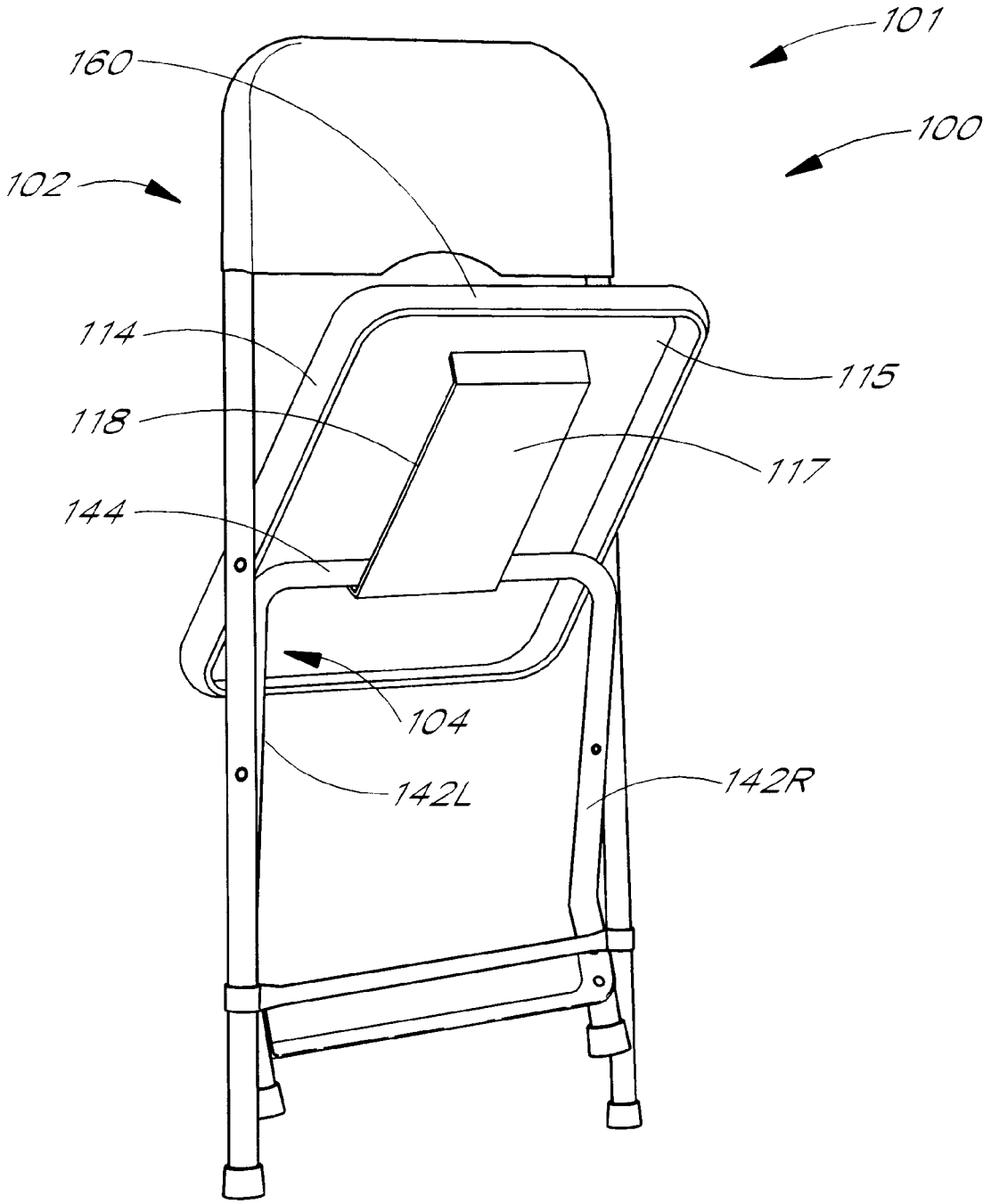
FIG. 2 is a perspective view of the folding chair of FIG. 1 with the chair shown in a folded position.

Reference will now be made to the drawings wherein like numerals referred like parts through out. FIGS. 1 and 2 illustrates the components of a folding chair 100 of the preferred embodiment. FIG. 1 depicts the folding chair 100 in a fully open state whereas FIG. 2 depicts the folding chair 100 in a folded state.

The primary source of mechanical support for the folding chair 100 is provided by a primary sub-structure 101 that is comprised of two pivotally connected U-shaped sections 102, 104 that are coupled to a seat rest 114 in a manner described below. To provide supplementary support to the sub-structure 101, a pair of safety guards 112 are attached to the sub-structure 101 to form the folding chair 100 described below.

The first U-shaped section 102 contains a left side section 130L, a lateral section 132 that extends orthogonally from the left section 130L, and a right side section 130R that extends orthogonally from the lateral section 132 to complete the U-shape of the section 102. In this description, the left side section 130L is on the left side of the folding chair 100 as defined by an observer looking at the front of the folding chair 100. The lower parts of sections 130L, 130R serve as a pair of front legs 136L, 136R with front bottom edges 154L, 154R. The bottom edges are covered with a pair of protective front shoes 174L, 174R that are adapted to provide non-slip contact with the floor so as to maintain the folding chair 100 in place.

The first U-shaped section 102 further contains a flat back rest 116 that is preferably fabricated from molded plastic. The back rest 116 is adapted to attach to the first U-shaped section 102 adjacent the lateral section 132 in a manner that allows the back rest 116 to be supported by sections 130L, 132 and 130R in a manner that is known in the art. The purpose of the back rest 116 is to allow the user to obtain a comfortable sitting position and to prevent the user from falling out of the folding chair 100 in a backwards direction.

The first U-shaped section 102 further contains a front brace 106 that connects the left and right sections 130L, 130R together at locations adjacent the front legs 136L, 136R. In this embodiment, the front brace 106 is located at the ends of the left section 130L and the right section 130R adjacent the front legs 136L and 136R respectively. The purpose of the front brace 106 is to provide lateral support to the first U-shaped section 102 so as to maintain the front legs 136L and 136R a first distance from each other that is selected to provide stability for the folding chair 100.

The second U-shaped section 104 contains a left section 142L, a lateral section 144 (see FIG. 2) that extends orthogonally from the left section 142L, and a right section 142R that extends orthogonally from the lateral section 144 to form the U-shape of the section 104. The left and right sections 142L, 142R contain a plurality of slight bends that enable the folding chair 100 to fold up in a compact manner as described below. The lateral section 144 is situated under the seat rest 114 as shown in FIG. 2 in a manner which is further described below. The lower parts of sections 142L, 142R serve as a pair of rear legs 152L, 152R with rear bottom edges 158L, 158R. The bottom edges are covered with a pair of protective rear shoes 156L, 156R that are adapted to provide non-slip contact with the floor so as to maintain the folding chair 100 in place.

The second U-shaped section 104 further contains a rear brace 110 that connects the left and right rear legs 152L, 152R together. In this embodiment, the rear brace 110 is located at the ends of the left section 142L and the right section 142R adjacent the rear legs 152L and 152R respectively. The purpose of the rear brace 110 is to provide lateral support to the second U-shaped section 104 so that the rear legs 152L and 152R are maintained a first distance apart from each other that is selected so as to provide stability for the folding chair 100.

The two U-shaped sections 102, 104 are pivotally attached at a pair of central pivot points 124L, 124R that coincide with the side sections 130L, 130R and 142L, 142R of the U-shaped sections 102, 104 respectively. The U-shaped sections 102, 104 are attached to each other in a manner that allows the sections 102, 104 to be aligned in a common plane when the chair 100 is in a folded or closed position. In addition, the U-shaped sections 102, 104 are attached to each other in a manner that allows the sections 102, 104 to be tilted with respect to each other such that the lateral section 144 of the second U-shaped section 104 supports the front of the folding chair 100 and the lateral section 132 of the first U-shaped section 102 supports the backrest 116 of the chair 100 when the chair is in an unfolded or open position.

The seat rest 114 is pivotally attached at a pair of rear corners 134L, 134R to a pair of pivot points 126L, 126R located on the first U-shaped section 102. The seat rest 114 is adapted to support the weight of the user when the user is seated in the chair 100. As shown in FIG. 2, a guide plate 117 is attached to a bottom surface 115 of the seat rest 114 to ensure that the seat rest 114 is supported at the front edge 160 when the folding chair 100 is in an open position. In particular, the lateral section 144 of the second U-section 104 is interposed between the guide plate 117 and the seat rest 114 so that the lateral section 144 is captured within a slot 118 that is formed between the bottom surface 115 and the guide plate 117. The lateral section 144 is movable within the slot 118 so that, when the user unfolds the folding chair 100 by placing the seat rest 114 into a horizontal position in a manner described below, the guide plate 117 directs the lateral section 144 of the second U-section 104 to be positioned adjacent the front edge 160 of the seat rest 114.

In a fully open position, the U-shaped sections 102, 104 are extended to a maximum angular displacement that is limited by the contact between the front edge 160 of the seat rest 114 and the lateral section 144 of the second U-section 104 as shown in FIG. 1. In a corresponding manner, the front legs 136L, 136R and rear legs 152L, 152R are simultaneously extended from each other to form a solid base of support for the folding chair 100. With the folding chair 100 unfolded in the foregoing manner and placed on a level solid surface with all four legs 136L, 136R and 152L, 152R touching the surface, the seat rest 114 of the folding chair 100 provides a horizontal sitting surface that is capable of supporting the weight of most individuals under normal conditions.

The primary source of mechanical support for the folding chair 100 is provided by the primary sub-structure 101 comprised of the two pivotally connected U-shaped section 102, 104 coupled to the seat rest 114 in the manner described above. However, if the seat rest 114 experiences a mechanical failure, the mechanical stability of the sub-structure 101 could be compromised, resulting in the user possibly falling to the floor. To improve the mechanical stability of the folding chair 100 and reduce the risk of the user falling to the floor, the pair of safety guards 112 are included in the design of the folding chair 100 in a manner described below.

Figure 3A:
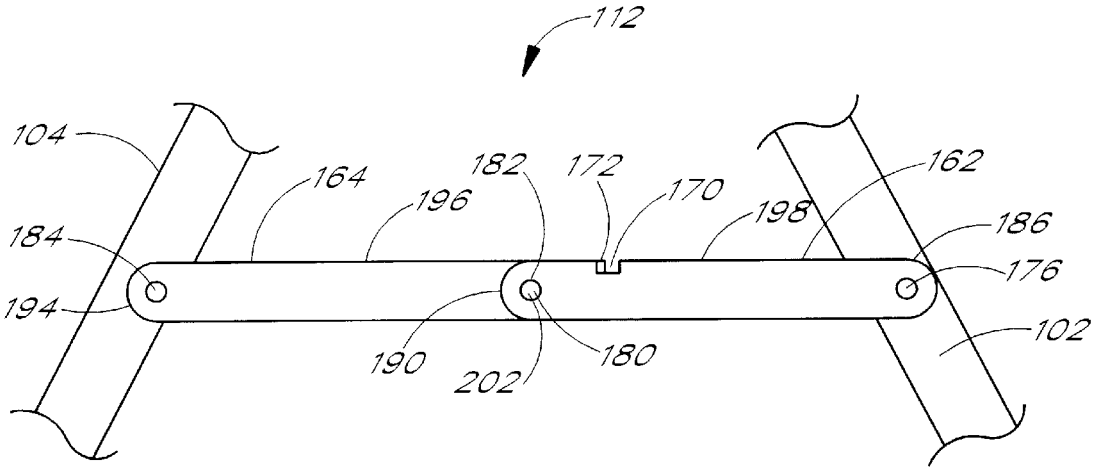
FIG. 3A is a plan view of a safety guard of the folding chair of FIG. 1 illustrating the safety guard in a fully extended position.
Figure 3B:
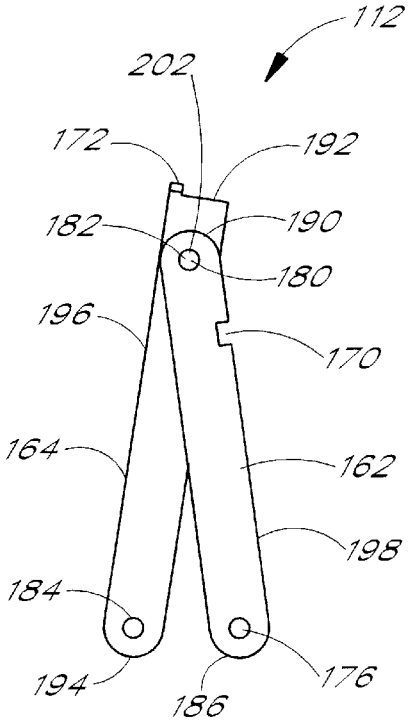
FIG. 3B is a plan view of the safety guard of the folding chair of FIG. 1 illustrating the safety guard in a folded position.
Figure 3C:
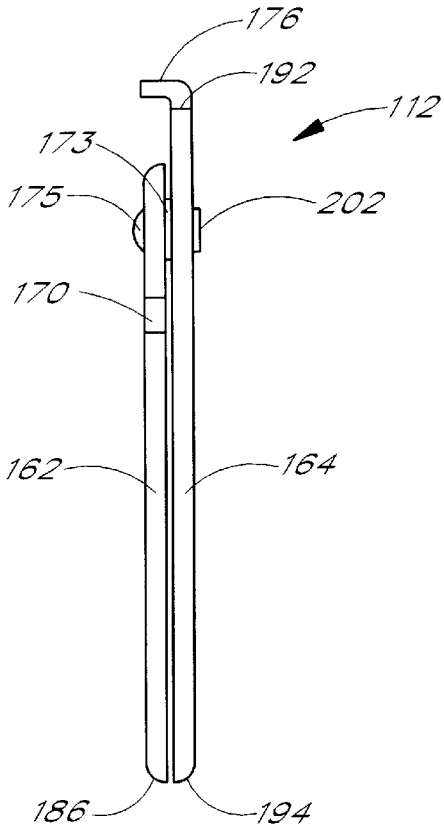
FIG. 3C is a side view of the safety guard of the folding chair of FIG. 1 illustrating the safety guard in a folded position.

In particular, FIGS. 3A–C illustrate the design of an individual safety guard 112. Each safety guard 112, in this embodiment, is comprised of a front section 162 and a rear section 164 both of which are constructed of steel with an approximate width of 0.50 inches, an approximate thickness of 0.06 inches, and an approximate length of 4 inches. The sections 162 and 164 are pivotally attached to each other in a manner described below.

The front section 162 contains a front attachment opening 176 and a rear attachment opening 180 that are both located along a centerline of the front section 162. The opening 176 of the front section 162 is located adjacent a rounded front edge 186 of the front section 162 and is used to pivotally attach the front section 162 to the first U-section 102 in a manner described below. The rear opening 180 is located adjacent a rounded rear edge 190 and is used to pivotally attach the front section 162 to the rear section 164 in a manner described below. The front section 162 further contains a rectangular indentation 170 along an upper edge 198 adjacent the rear opening 180. The indentation 170 limits the motion of the safety guard 112 in a manner described below.

The rear section 164 is constructed with a front attachment opening 182 and a rear attachment opening 184 that are located along a centerline of the rear section 164. The front opening 182 of the rear section 164, located adjacent a front edge 192 as shown in FIG. 3C, is used to pivotally attach the rear section 164 to the front section in a manner described below. The rear opening 184 of the rear section 164 is located adjacent a rounded rear edge 194. The rear opening 184 is used to pivotally attach the rear section 164 to the second U-section 104 in a manner described below.

The front edge 192 of the rear section 164 of the safety guard 112 forms a straight edge along most of its length as shown in FIG. 3B. A narrow lip 172 extends in an orthogonal direction from the rear edge 192 adjacent an upper edge 196 as is best shown in FIGS. 3C. As will be described in a following section, the lip 172 engages with the indentation 170 and places a limit on the motion of the safety guard 112.

The front and rear sections 162, 164 of the safety guard 112 are attached to each other in a manner that allows both sections 162, 164 to lie in parallel planes with the rear edge 190 of the front section 162 overlapping the front edge 192 of the rear section 164. Furthermore, the front and rear sections 162, 164 are pivotally attached at a pivot center 202 that coincides with the rear opening 180 of the front section 162 and the front opening 182 of the rear section 164.

In this embodiment, a rotatable coupler in the form of a rivet 175 extends through the rear opening 180 of the front section 162 and the front opening 182 of the rear section 164 to provide a means for pivotally attaching the front and rear section 162, 164 together. In addition, a washer 173 is interposes between sections 162, 164 to provide a minimal spacing between sections 162, 164 to facilitate pivoting motion of the members.

Figure 4:
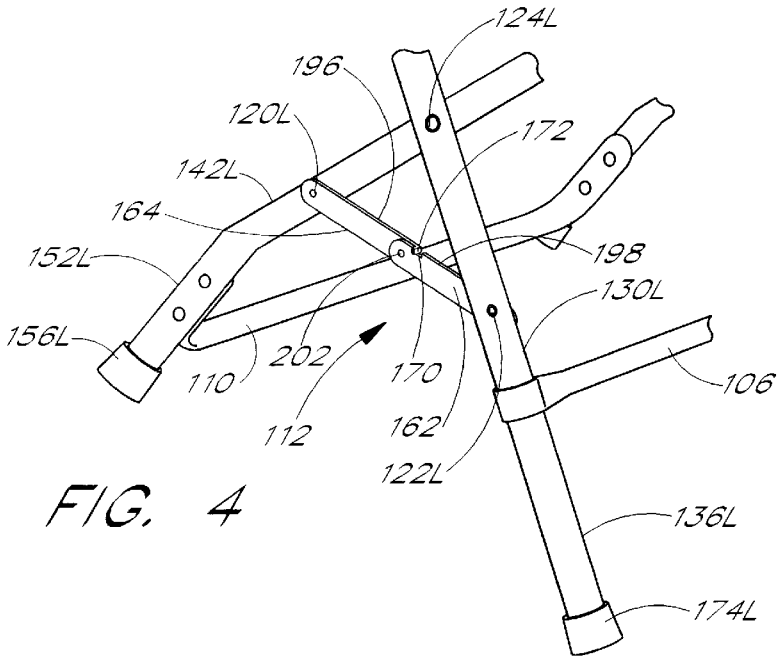
FIG. 4 is a magnified perspective view of the folding chair of FIG. 1 illustrating the safety guard in a fully extended position.

FIG. 4 illustrates the relationship between an individual safety guard 112 and the left side sections 130L and 142L of the U-shaped sections 102 and 104 respectively of the folding chair 100. An identical relationship also exists between the safety guard 112 and the right side sections 130R and 142R of the U-shaped sections 102 and 104.

The safety guards 112 are pivotally attached in a fixed manner to both U-sections 102, 104 of the folding chair 100 below the central pivot points 124L, 124R. In particular, the front sections 162 of the safety guards 112 are attached through the front opening 176 to the side sections 130L, 130R of the first U-section 102 at a pair of front pivot points 122L, 122R located between the central pivot points 124L, 124R and the front brace 106. Furthermore, the rear sections 164 of the safety guards 112 are attached through the rear opening 184 to the side sections 142L, 142R of the second U-section 102 at a pair of rear pivot points 120L, 120R located between the central pivot points 124L, 124R and the rear brace 110.

As mentioned above, the front and rear sections 162, 164 of the safety guides 112 are shaped in a manner that restricts the movement of the pivot center 202 of the safety guides 112. In particular, the indentation 170 adjacent the front edge 190 along an upper edge 198 of the front section 162 is adapted to receive the lip 172 (see FIG. 3A–C) that extends in a perpendicular manner from the front edge 192 of the rear section 164 adjacent the upper edge 196. Moreover, when the U-sections 102, 104 of the folding chair 100 are tilted to a fully open position, the safety guards 112 are fully extended in a simultaneous manner to an extent where the lip 170 makes contact with indentation 172, thus reaching the maximum extension of the safety guards 112 as shown in FIG. 4. In this configuration, the front section 162 and the rear section 164 of the safety guard 112 form a single linear brace between the side section 130 of the first U-shaped member 102 and the side section 142 of the second U-shaped member 104. Furthermore, when the safety guards 112 are placed into a fully extended state, the pivot center 202 of each safety guard 112 lies along a line that joins the rear pivot point 120L, 120R to the front pivot point 122L, 122R.

It will be appreciated that the safety guides 112 add significant structural integrity to the folding chair 100. In particular, if the seat rest 114 undergoes a mechanical failure to the extent where the seat rest 114 is unable to maintain significant inward forces on the U-sections 102, 104, then the safety guards 112 will tend to prevent the folding chair 100 from collapsing by applying equilibrium restoring inward forces on the U-sections 102, 104 at the front and rear pivot points 122L, 122R and 120L, 120R. Furthermore, the supplemental structural support provided by the safety guards 112 reduces the internal stresses throughout the folding chair 100.

In particular, a common failure of these chairs occur when the lateral section 144 of the second U-shaped member 102 deforms the guide plate 117 and escapes from the channel 118. In this circumstance, the force of the person sitting on the seat 114 has a tendency to force the bottom legs 154R/154L of the first U-shaped member 102 away from the bottom legs 174R/174L from the second U-shaped member 104. This can result in an individual positioned on the seat to suddenly be accelerated towards the floor such that the individual hits the floor before the individual has time to react.

To avoid this problem, the braces 112 limit the outward movement of the first U-shaped member 102 from the second U-shaped member 104 in the event that the seat 114 detaches from the U-shaped members 102 or 104. While the seat 114 may no longer be able to support the user, retaining the U-shaped members 102 and 104 at the desired distance from each other reduces the speed of collapse of the chair 100 and provides the individual with more time to step up from the seat of the chair 114 and avoid falling to the floor.

It will be appreciated that the shape of the safety guards 112 described above prevents the pivotally attached safety guards 112 from overextending in a manner that allows the pivot center 202 of each safety guard 112 to fall below a line that joins the rear pivot point 120L, 120R to the front pivot point 122L, 122R. This feature ensures that the pair of safety guards 112 are biased to fold together at the central pivot 202 in a symmetrical manner which allows the folding chair 100 to be more easily converted from an open position to a folded position as will be described in a following section.

It will be appreciated that the safety guards 112 also help to prevent the user from inadvertently causing the folding chair 100 to change from an unfolded state to a folded state. For example, if a user is sitting on the folding chair 100 and pulls themselves forward, it is possible for inward forces to be created that are applied by the ground onto the front legs 136L, 136R. These inward forces have a tendency to urge the first U-shaped member 102 toward the second U-shaped member 104. Hence, without the safety guards 112, it would be possible for the U-sections 102, 104 to dangerously move toward a partially folded state that reduces the stability of the chair 100 which can cause the user to possibly fall out of the chair 100. However, with the safety guards 112 installed and placed in a fully extended position as shown in FIG. 4, inward forces applied onto the safety guards 112 by the U-section 102, 104 at the front and rear pivot points 122L, 122R and 120L, 120R would be directed through the pivot center 202 of the safety guards 112 which would therefore be ineffective at rotating the safety guards 112 into a folded position. Therefore, the fully extended safety guards 112 present an obstacle to the U-sections 102, 104 that help to maintain a fixed relationship between the U-sections 102, 104.

It will be appreciated that the folding chair 100 is easily converted from a folded state to a fully opened state. The user simply places the front legs 136L, 136R of the folding chair 100 on a suitable horizontal surface, holds the first U-section 102 in a vertical manner, and pushes down on the front edge 160 of the seat rest 114 which causes the U-sections 102, 104 to unfold. Subsequently, the user places the folding chair 100 on both the front and rear legs 136L, 136R and 152L, 152R and applies a downward force on the front edge 160 until the lateral section 144 of the second U-section comes into contact with the front edge 160 of the seat rest 114. To ensure that the safety guards 112 are fully extended, the user simply applies a downward force on the middle of each safety guard 112 until the lip 172 of each safety guard 112 comes into contact with the corresponding rectangular indentation 170.

It will be appreciated that the folding chair 100 is easily converted from a fully opened state to a folded state. The user starts the folding process by applying an upward force on the middle of each safety guard 112 which causes the central pivot 202 to rise above the line that joins the front and rear pivot points 122L, 122R and 120L, 120R of the U-sections 102, 104. At this point, the user simply orients the first U-section 102 in a vertical manner and pulls up on the front edge 160 of the seat rest 114 which rotates the seat rest 114 in a manner that exposes the lower surface 115 and directs the lateral section 144 to move away from the front edge 160 of the seat rest 114. The user continues this process until the plane of the seat rest 114 lines up with the plane of the first U-section 102 at which point the U-sections 102, 104 will be aligned with each other and the safety latches 112 will be placed in a folded position.

It will be appreciated that the safety guards 112 are configured to extend with a fully extended orientation when the chair 100 is converted from an unfolded state to a fully opened state. In particular, each safety guards 112 is mounted to the chair 100 in a manner that matches the distance between the front and rear pivot points 122 and 120, measured when the chair 100 is in a fully opened state, with the distance between the front opening 176 and rear opening 184 of the safety guard 112, measured with the safety guard in a fully extended state.

It will also be appreciated that the safety guards 112 are configured to remain extended with a fully extended orientation while a user is sitting in the chair 100. In particular, the engagement between the lip 172 and the indentation 170 of each safety guard 112 in a fully extended orientation prevents the pivot center 202 of the safety guard 112 from falling below a line that joins the front and rear pivot points 122 and 120. This adaptation prevents gravitational forces acting on the safety guard 112 from altering the linear alignment of the safety guards 112.

It will be appreciated that the safety guards 112 provide the folding chair 100 with significant advantages while offering little or no significant drawbacks. In particular, the safety guards 112 provide improved structural reliability to the folding chair 100 and reduce the risk of injury to the user. Furthermore, the safety guards 112 are lightweight, easy to manipulate, inexpensive to produce, and inexpensive to install onto the folding chair 100.

Although the preferred embodiment of the present invention has shown, described and pointed out the fundamental novel features of the invention as applied to this embodiment, it will be understood that various omissions, substitutions and changes in the form of the detail of the device illustrated may be made by those skilled in the art without departing from the spirit of the present invention. Consequently, the scope of the invention should not be limited to the foregoing description, but should be defined by the appending claims.

What is claimed is:

1. A folding chair having a folded and an unfolded configuration comprising:

a first chair support member defining a first left section and a second right section;

a second chair support member defining a second left section and a second right section wherein both the first and second chair support members are pivotally attached to each other so that when the chair is in a folded configuration, the first and second right sections and the first and second left sections of the first and second chair support members are substantially co-planar and wherein the first and second left sections and the first and second right sections form acute angles with each other when the chair is in the unfolded configuration;

a seat that is attached to the first and second chair support members so as to be positioned substantially co-planar with the first and second chair support members when the chair is in the folded configuration and wherein the seat is attached to the first and second chair support members so that the seat is positioned so as to be substantially parallel to a surface upon which the first and second chair support members are positioned when the chair is in the unfolded configuration; and at least one safety brace member which includes a first and a second section that are pivotally attached to each other at a central pivot, wherein the first section of the at least one brace member is pivotally attached in a fixed manner to the first chair support member at a first pivot and the second section of the brace member is pivotally attached in a fixed manner to the second chair support member at a second pivot so that when the chair is in the unfolded position, the first and second sections of the at least one brace member are positioned so as to retain the first and second chair support members in a first relation with each other so as to reduce a tendency of a user falling to the surface upon which the first and second chair support members are positioned if the seat becomes dis-attached to the first or the second chair support member and wherein the first and second section of the at least one brace member are pivotally attached to each other so that when the chair is in the folded configuration, the first and second sections of the at least one brace member are essentially coplanar with the first and second chair support members, wherein the at least one brace member is adapted to be biased to maintain a linear configuration when the chair is in the unfolded configuration so as to prevent a user who is sitting in the chair from inadvertently causing the chair to change to a folded configuration, wherein the at least one safety brace member contains an orthogonally extending lip from the first section of the at least one brace member adjacent a first upper edge of the at least one brace member, wherein the lip is adapted to engage with a rectangular indentation located along a second upper edge on the second section of the at least one safety brace member when the chair is placed in the unfolded configuration.

2. The folding chair of claim 1, wherein the first chair support member is shaped in the form of a U with a left side section, a lateral section, and a right side section such that the ends of the side sections of the first support member form a pair of front legs and wherein the second chair support member is shaped in the form of a U with a left side section, a lateral section, and a right side section such that the ends of the side sections of the second support member form a pair of rear legs, wherein the first and second chair support members are pivotally attached in a fixed manner at a left upper pivot located on the left side of the chair and a right upper pivot located on the right side of the chair.

3. The folding chair of claim 2, wherein the at least one brace member is comprised of a left brace member that is mounted on the left side of the folding chair and a right brace member that is mounted on the right side of the folding chair, wherein the left brace member is substantially identical to the right brace member, wherein the first and second pivots of the left brace member are located below the left upper pivot, wherein the first and second pivots of the right brace member are located below the right upper pivot, wherein the elevation of the first and second pivots of the right brace member are substantially identical to the elevation of the first and second pivots of the left brace member.

4. The folding chair of claim 2, further comprising a guide plate that is attached on a bottom surface of the seat in a manner that allows the lateral section of the second support member to be interposed between the guide plate and the bottom surface of the seat, wherein a slot that is formed between the guide plate and the seat directs the lateral section of the second support member toward a front edge of the seat when the chair is converted from a folded configuration to an unfolded configuration so as to support the seat in the unfolded configuration, wherein the slot between the guide plate and the seat also directs the lateral section of the second support member away from a front edge of the seat when the chair is converted from an unfolded configuration to a folded configuration.

5. The folding chair of claim 1, wherein the at least one brace member is placed into a folded position with the central pivot of the at least one brace member located above a line that joins the first and second pivots of the at least one brace member when the chair is placed in the folded configuration.

6. The folding chair of claim 1, wherein the first and second sections of the at least one brace member are constructed of steel with a width approximately equal to 0.5 inches, a length approximately equal to 4 inches and a thickness approximately equal to 0.06 inches.

7. The folding chair of claim 1, wherein the engagement of the lip with the indentation causes the central pivot to line up with the first and second pivots of the at least one brace member so that the engagement of the lip with the indentation prevents the central pivot of the at least one brace member from dropping below a line that joins the first and second pivots of the at least one brace member to thereby bias the at least one brace member into the linear configuration.

8. A folding chair having a folded and an unfolded configuration comprising:

a first chair support member defining a first left section and a second right section;

a second chair support member defining a second left section and a second right section wherein both the first and second chair support members are pivotally attached to each other so that when the chair is in a folded configuration, the first and second right sections and the first and second left sections of the first and second chair support member are substantially co-planar and wherein the first and second left sections and the first and second right sections form acute angles with each other when the chair is in the unfolded configuration;

a seat that is attached to the first and second chair support members so as to be positioned substantially co-planar with the first and second chair support members when the chair is in the folded configuration and wherein the seat is attached to the first and second chair support members so that the seat is positioned so as to be substantially parallel to a surface upon which the first and second chair support members are positioned when the chair is in the unfolded configuration; and at least one safety brace member which includes a first section that has an orthogonally extending lip adjacent a first upper edge of the at least one brace member and a second section that has an indentation adjacent a second upper edge of the at least one brace member, the first and second sections are pivotally attached to each other at a central pivot, wherein the first section of the at least one brace member is pivotally attached in a fixed manner to the first chair support member at a first pivot and the second section of the brace member is pivotally attached in a fixed manner to the second chair support member at a second pivot so that when the chair is in the unfolded configuration, the lip of the first section is positioned within the indentation in the second section so that the first and second sections are biased into a linear configuration such that the at least one brace member is positioned to retain the first and second chair support members in a first relation with each other so as to reduce a tendency of a user falling to the surface upon which the first and second chair support members are positioned if the seat becomes dis-attached to the first or the second chair support member and wherein the first and second sections of the at least one brace member are pivotally attached to each other so that when the chair is in the folded configuration, the first and second sections of the at least one brace member are essentially coplanar with the first and second chair support members.

9. The folding chair of claim 8, wherein the at least one brace member is placed into a folded position with the central pivot of the at least one brace member located above a line that joins the first and second pivots of the at least one brace member when the chair is placed in the folded configuration.

10. The folding chair of claim 8, wherein the first and second sections of the at least one brace member are constructed of steel with a width approximately equal to 0.5 inches, a length approximately equal to 4 inches and a thickness approximately equal to 0.06 inches.

11. The folding chair of claim 8, wherein the first chair support member is shaped in the form of a U with a left side section, a lateral section, and a right side section such that the ends of the side sections of the first support member form a pair of front legs and wherein the second chair support member is shaped in the form of a U with a left side section, a lateral section, and a right side section such that the ends of the side sections of the second support member form a pair of rear legs, wherein the first and second chair support members are pivotally attached in a fixed manner at a left upper pivot located on the left side of the chair and a right upper pivot located on the right side of the chair.

12. The folding chair of claim 11, wherein the at least one brace member is comprised of a left brace member that is mounted on the left side of the folding chair and a right brace member that is mounted on the right side of the folding chair, wherein the left brace member is substantially identical to the right brace member, wherein the first and second pivots of the left brace member are located below the left upper pivot, wherein the first and second pivots of the right brace member are located below the right upper pivot, wherein the elevation of the first and second pivots of the right brace member are substantially identical to the elevation of the first and second pivots of the left brace member.

13. The folding chair of claim 12, further comprising a guide plate that is attached on a bottom surface of the seat in a manner that allows the lateral section of the second support member to be interposed between the guide plate and the bottom surface of the seat, wherein a slot that is formed between the guide plate and the seat directs the lateral section of the second support member toward a front edge of the seat when the chair is converted from a folded configuration to an unfolded configuration so as to support the seat in the unfolded configuration, wherein the slot between the guide plate and the seat also directs the lateral section of the second support member away from a front edge of the seat when the chair is converted from an unfolded configuration to a folded configuration.

* * * * *